US005174567A

United States Patent [19]

Nordstrom

[11] Patent Number: 5,174,567

[45] Date of Patent: Dec. 29, 1992

[54] ATHLETIC TRAINING DEVICE

[76] Inventor: Duane R. Nordstrom, 147 Alpine Dr., Green Bay, Wis. 54302

[21] Appl. No.: 567,310

[22] Filed: Aug. 14, 1990

[51] Int. Cl.[5] ..... A63B 59/14; A63B 69/00

[52] U.S. Cl. ..... 273/67 A; 273/193 R

[58] Field of Search ..... 273/67, 192, 193 R; 108/129

[56] References Cited

U.S. PATENT DOCUMENTS

| | | | |
|---|---|---|---|
| 1,993,911 | 3/1935 | Abrams | 273/67 R |
| 3,175,328 | 3/1965 | Tricarico | 273/67 R |
| 3,319,964 | 5/1967 | Steinberg | 273/192 |
| 3,351,346 | 11/1967 | Straham | 273/193 R |
| 3,529,825 | 9/1970 | White | 273/67 A |
| 3,834,697 | 9/1974 | McNamara | 273/67 A |
| 3,851,880 | 12/1974 | Ritch | 273/67 A |
| 4,111,419 | 9/1978 | Pellegrino | 273/67 A |
| 4,364,560 | 12/1982 | Gemmel | 273/67 A |
| 4,491,320 | 1/1985 | Smith | 273/67 A |
| 4,688,799 | 8/1987 | Johnson | 273/192 |
| 4,887,837 | 12/1989 | Bonewicz, Jr. et al. | 108/129 |

FOREIGN PATENT DOCUMENTS

| | | | |
|---|---|---|---|
| 277146 | 9/1927 | United Kingdom | 273/67 R |

*Primary Examiner*—William H. Grieb
*Assistant Examiner*—Mark S. Graham
*Attorney, Agent, or Firm*—Godfrey & Kahn

[57] ABSTRACT

An athletic training device including a shaft having a proximal end which is held in the hands of a user and an opposite distal end, a striking surface having opposite first and second ends wherein the first end of the striking surface is fixed on the distal end of the shaft, an axle assembly fixed on the second end of the striking surface and defining an axis of rotation, a wheel having a predetermined weight and a central bore and wherein the wheel assembly is received in the bore to render the wheel rotatable about the axis of rotation, and a means for releasably securing the wheel onto the axle assembly. The axle assembly supports the striking surface in a spaced relation to the surface of the earth, and movement of the striking surface across the surface of the earth by a user causes rotation of the wheel which facilitates movement of the athletic training device in a predetermined pattern to emulate an athletic event and simultaneously provides weighted resistance for athletic conditioning.

12 Claims, 3 Drawing Sheets

ATHLETIC TRAINING DEVICE

FIELD OF THE INVENTION

The present invention relates to a new and novel athletic training device, and more particularly to a hand held athletic training device which is operable for rolling engagement with the surface of the earth and which permits a user to emulate an athletic event while simultaneously providing weighted resistance to the user for purposes of athletic conditioning.

BACKGROUND OF THE INVENTION

Since the dawn of athletic competition, athletes have searched for athletic training devices which would efficiently and effectively prepare the athlete for the rigors of competition. Accordingly, it is well known in the sport of hockey, and in other sports such as baseball, tennis and golf, that the addition of a detachable weight to athletic equipment, during athletic training, effectively conditions appropriate muscle groups of the athlete thereby enhancing the athlete's strength, coordination and reflexes. However, and in order for an athlete to be sufficiently prepared for a forthcoming season of competition, an athlete must, in addition to performing strength training, i.e. weight lifting and training with weighted athletic equipment, also spend countless hours performing endurance training, that is, specifically, aerobic and anaerobic training. In this regard, it should be understood that aerobic training conditions an athlete's heart and lungs for long periods of physical stress, and anaerobic training conditions an athlete's body for short bursts of maximum energy alternating with brief periods of recovery.

In general, aerobic training is a necessary off-season activity for an athlete because it enables the athlete to achieve a high level of heart-lung efficiency which serves as a foundation for the athlete's anaerobic conditioning that comprises much of an athlete's pre-season workouts. For example, and in the course of ice hockey training, aerobic training is a necessary off-season activity because such aerobic training serves as a foundation for an ice hockey player's anaerobic conditioning which traditionally occurs three to four weeks prior to scheduled seasonal on-ice hockey practice.

Running has traditionally been a popular method for achieving necessary off-season aerobic conditioning. However, and in such sports as ice hockey, skating on Rollerblades® is also an excellent method for achieving the necessary off-season aerobic fitness. As should be understood, RollerblIades® are a pair of skate-like boots which have a plurality of in-line wheels which comprise a single "blade" of wheels which are attached to each boot. Rollerblades® is a registered trademark of Rollerblade Inc. of Minneapolis, Minnesota.

It is known to ice hockey players that achieving aerobic fitness by skating on Rollerblades® produces less stress on their knees and feet as compared to the stress produced on the knees and feet as a consequence of running. Further, it is known to ice hockey players that skating on Rollerblades® simulates athletic movements that traditionally occur during the course of an ice hockey game, and that such off-season aerobic training on Rollerblades® could conceivably be integrated with ice hockey stick handling practice.

As earlier discussed, the prior art is replete with athletic training devices which suggest the use of weighted members which are detachably fixed to the shaft of an athletic implement for the purpose of adding weight to the athletic implement thereby providing strength training for appropriate muscle groups of the athlete. For example, one prior art device includes a weighted box-like member which is releasably fixed to the shaft of an ice hockey stick for the purpose of conditioning the ice hockey player's appropriate muscle groups during on-ice hockey practice. Other prior art athletic training devices suggest the use of a detachable U-shaped weight, the internal shape of which is substantially equal to the cross sectional shape of the athletic implement. Such U-shaped weights when used in the sport of ice hockey, for example, would have an internal shape substantially equal to the cross sectional configuration of the shaft of an ice hockey stick.

While the prior art athletic training devices have operated with some degree of success, the devices do, however, suffer from a multiplicity of drawbacks which have detracted from their usefulness. For example, there exists a significant problem in the aforementioned prior art weighted athletic training devices inasmuch as the prior art athletic training devices do not permit an ice hockey player to effectively integrate off-season aerobic training and pre-season anaerobic training with strength training and ice hockey stick handling practice because the ice hockey player's ice hockey stick becomes irreparably damaged. More specifically, off-season aerobic training and pre-season anaerobic training for the ice hockey player is typically accomplished by running on a hardened, earthen surface, or by skating with Rollerblades® on a hardened, paved surface. Accordingly, any use of an ice hockey stick with an attached prior art weighted training devices during such aerobic/anaerobic training on such hardened, abrasive surfaces, usually, severely damages the blade end of the ice hockey stick, thus rendering it unserviceable. For example, should the ice hockey player dribble a hockey puck while running on a hardened, un-iced, earthen surface, or dribble a hockey puck while skating with Rollerblades® on an un-iced, paved surface, severe structural damage would occur to the blade end of the ice hockey stick due to constant frictional contact of the blade end of the ice hockey stick with the abrasive, un-iced, earthen surface.

Still another significant problem with the prior art weighted devices results from characteristics inherent in their design. Specifically, the prior art devices have not been operable to rollingly engage the surface of the earth thereby permitting an athlete to realistically emulate the stick handling techniques fundamental to competitive hockey with the attendant result that off season hockey players do not improve as significantly in their performance as might otherwise be expected.

Therefore, it has long been known that it would be desirable to have an athletic training device which would allow an athlete to integrate off-season aerobic training and preseason anaerobic training with strength training, while simultaneously allowing the athlete to emulate the movement of the athletic device in a fashion customary to the sport for which the device is used without damaging the athletic device by frictional engagement with the surface of the earth.

SUMMARY OF THE INVENTION

Therefore, it is an object of the present invention to provide an improved athletic training device.

Another object of the present invention is to provide such an athletic training device which will allow an athlete to integrate off-season aerobic training and pre-season anaerobic training with strength training, while simultaneously allowing the athlete to realistically emulate the movement of the athletic device without damaging same.

Another object of the present invention is to provide such an athletic training device which allows an athlete, such as an ice hockey player, to practice ice hockey stick handling techniques during the off season without damaging an ice hockey stick.

Another object of the present invention is to provide such an athletic training device which allows an athlete, such as an ice hockey player to practice ice hockey stick handling techniques during the ice hockey season on an iced surface.

Another object of the present invention is to provide such an athletic training device which is characterized by ease of utilization, simplicity of construction, and which further can be manufactured and maintained at a relatively nominal expense.

Another object of the present invention is to provide such an athletic training device which has particular utility for an athlete during the off-season.

Another object of the present invention is to provide such an athletic training device which is operable to obtain the individual benefits to be derived from the related prior art devices while avoiding the detriments individually associated therewith.

Another object of the present invention is to provide such an athletic training device which allows the athlete to select a desired weighted resistance for the athletic training device thereby providing the athlete with greater flexibility during athletic training.

Another object of the present invention is to provide such an athletic training device wherein, in a second form, the athletic training device detachably mounts to a blade end of an ice hockey stick, and wherein the athletic training device is operable for movement across the surface of the earth and can be used in combination with the athlete's game ice hockey stick thereby allowing the athlete to perfect his ice hockey skills with the actual hockey stick he will use in competition.

Another object of the present invention is to provide such an athletic training device which can be adapted for use with other sports which utilize athletic implements which engage the surface of the earth such as field hockey, polo, and golf.

Further objects and advantages of the present invention are to provide improved elements and arrangements thereof in athletic training devices for the purposes described which are dependable, economical, durable, and fully effective in accomplishing their intended purposes.

These and other objects and advantages are achieved in an athletic training device of the present invention wherein, in the preferred embodiment, the apparatus includes a shaft with a proximal end which is held in the hands of an athlete and an opposite distal end, and wherein a striking surface having opposite first and second ends is fixed on the distal end of the shaft, and wherein an axle assembly is fixed on the second end of the striking surface, and wherein a wheel having a predetermined weight and a central bore mounts on the axle assembly, and wherein a means for releasably securing the wheel is located on the axle assembly, and wherein the wheel supports the striking surface in a spaced relation to the surface of the earth, and wherein movement of the striking surface across the surface of the earth causes rotation of the wheel to facilitate movement of the athletic training device in a predetermined pattern to emulate an athletic event, and to provide weighted resistance for athletic conditioning.

DETAILED DESCRIPTION OF INVENTION

Having now generally described the beneficial functions and features of the present invention, the best mode of operation contemplated by this inventor is set forth below. Although the following detailed description o the present invention relates to an athletic training device for use in the sport of ice hockey, similar athletic training devices may be developed and be employed in such sports as field hockey, polo, golf, or any sport which includes an athletic implement which is adapted to engage the surface of the earth.

FIRST FORM

Figures 1, 2, 3:
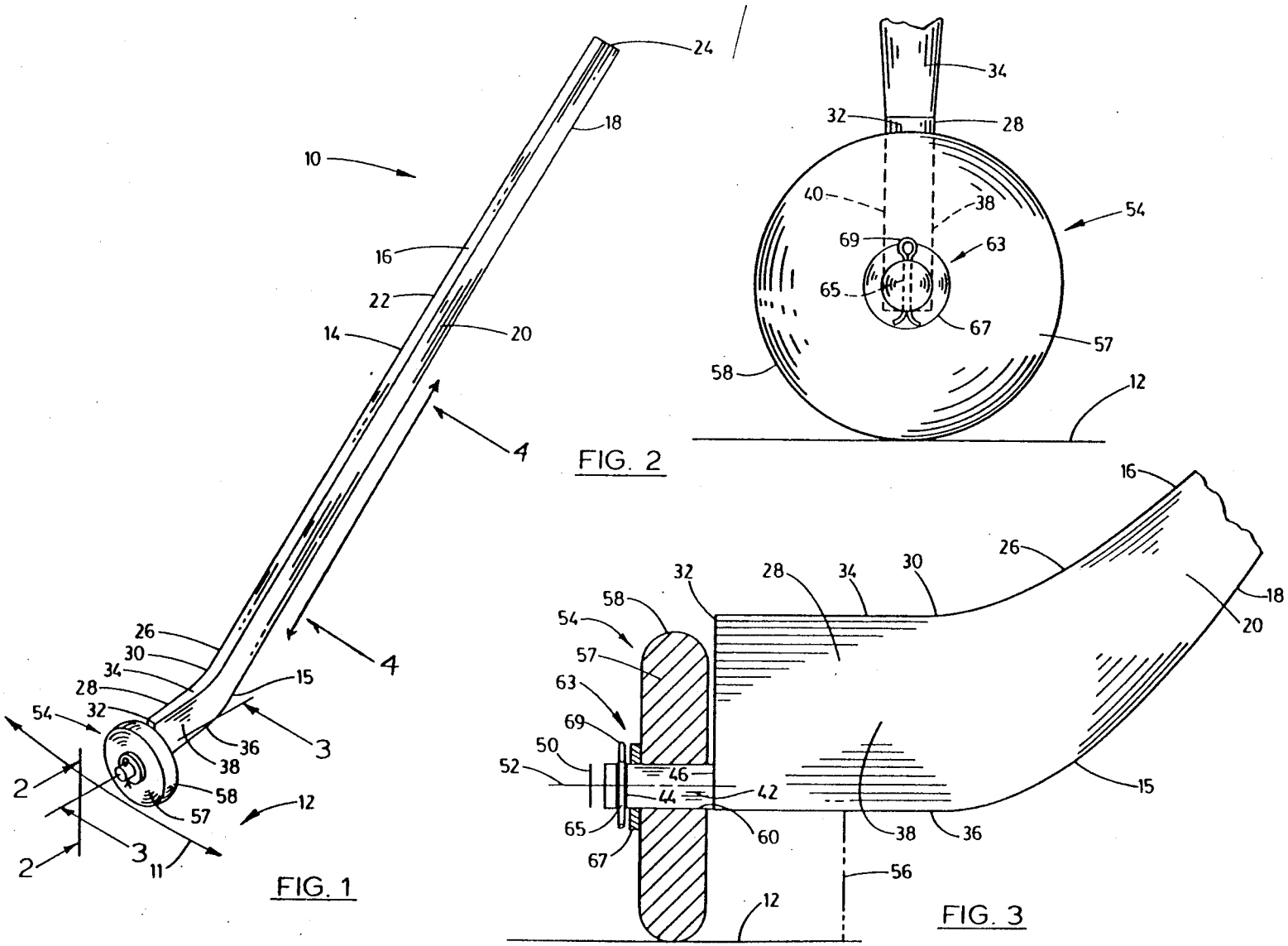
FIG. 1 is a perspective environmental view of a first form of the athletic training device of the present invention.
FIG. 2 is a fragmentary, front elevational view of the first form of the present invention taken from a position along line 2—2 of FIG. 1.
FIG. 3 is a fragmentary, longitudinal, vertical sectional view of the first form of the present invention taken from a position along line 3—3 of FIG. 1.

Referring more particularly to the drawings, the athletic training device of the present invention is generally indicated by the numeral 10 in FIG. 1.

The athletic training device 10, which is illustrated generally in FIG. 1, and described below, is operable, for example, to be held by an athlete, not shown, and is adapted for movement along a substantially arcuate path of travel 11 across the surface of the earth 12 to emulate an athletic event such as ice hockey.

As best seen by reference to FIG. 1, the device 10 of the first form of the present invention is shaped to resemble an ice hockey stick; accordingly, the device 10 has a shaft 14, a heel 15, and a striking surface which will hereinafter be discussed in greater detail.

Referring more particularly to FIG. 1, the device 10 has an elongated, substantially rectangular shaft 14 which has a top surface 16, an opposed bottom surface 18, and opposite left and right lateral surfaces 20 and 22, respectively. The shaft 14 further includes a proximal end 24, a distal end 26, and a longitudinal line of reference which is indicated by the line labeled 4—4. Fixed in non-coaxial alignment relative to the longitudinal line of reference of 4—4, and on the distal end 26 of the shaft 14 is striking surface 28. Striking surface 28 has opposite first and second ends represented by the numerals 30 and 32 respectively, a top peripheral surface or edge 34, an opposed bottom peripheral surface or edge 36, a front striking surface 38, an opposed rear striking surface 40, and a line of reference which is indicated by the line labeled 3—3. The first end 30 of the striking surface 28 is fixed on the distal end 26 of the shaft 14 at a predetermined angle relative to the longitudinal line of reference 4—4. This predetermined angle is referred to as "lie" in the sport of hockey. "Lie" is typically represented by a reference number. More particularly, the higher the "lie" number of the device 10, the smaller the angle between the longitudinal lines of references 3—3 and 4—4. Alternatively, the lower the "lie" number, the larger the angle between the longitudinal lines of references 3—3 and 4—4. For example, an angle of 115° between the longitudinal lines of references 3—3 and 4—4 has a corresponding "lie" number of 15, and an angle of 136.5° between the longitudinal lines of references 3—3 and 4—4 has a corresponding "lie" number of 5. As should be understood, the device 10 can be manufactured to incorporate any "lie" corresponding to the needs and desires of an end user.

An athlete, not shown, who utilizes the device 10 controls same to emulate ice hockey stick handling techniques and maneuvers by grasping the proximal end 24 of the shaft 14. The device 10, and more particularly the shaft 14, the heel 15, the proximal end 24, the distal end 26 and the striking surface 28 thereof are generally shaped in a fashion similar to an actual ice hockey stick thereby providing an athlete with the "look" and "feel" of an actual ice hockey stick. This, of course, provides the athlete with realistic off-season and pre-season ice hockey stick handling training.

The materials necessary to manufacture the shaft 14, and the striking surface 28 of the device 10 are similar to materials utilized to manufacture an actual ice hockey stick. More particularly, the shaft 14 and the striking surface 28 can be manufactured from natural materials, such as ash, birch, elm or hickory. Alternatively, the shaft 14 and the striking surface 28 can be manufactured from synthetic materials including, but not limited to fiberglass, plastic, graphite and combinations thereof.

As best seen by reference to FIGS. 2 and 3, an axle assembly 42 is fixed on the second end 32 of the striking surface 28. The axle assembly 42 includes opposite first and second ends which are indicated by the numerals 44 and 46, respectively. The second end 46 of the axle assembly 42 is fixed on the second end 32 of the striking surface 28 and is disposed in substantially coaxial registry with the line of reference 3—3 of FIG. 1, and extends substantially longitudinally, outwardly therefrom. As best illustrated in FIGS. 2 and 3, the axle assembly 42 is a smooth, substantially cylindrically shaped member which has a diametral dimension which is indicated by the line labeled 50. Axle assembly 42 provides an axis of rotation 52 for a wheel assembly which is generally indicated by the numeral 54. Furthermore, the axle assembly 42 provides a means for mounting the wheel assembly 54, and a means for supporting the striking surface 28 in a predetermined spaced relationship 56 relative to the surface of the earth 12.

FIGS. 2 and 3 illustrate the preferred embodiment of the wheel assembly 54. The wheel assembly 54 has a predetermined weight to provide weighted resistance for strength training during use of the device 10. The wheel assembly 54 has a main body 57 which includes an outer peripheral edge which defines an outer diametral dimension and which further defines an earth engaging surface 58. The main body 57 of the wheel assembly 54 further includes an inner peripheral edge which defines a substantially centrally disposed bore 60 having a predetermined inner diametral dimension. The bore 60, which has a diametral dimension greater than the diametral dimension of the axle assembly 42, is operable to rotatably receive the axle assembly 42 thereby rendering the wheel assembly 54 rotatable about the axis of rotation 52.

As best seen by reference to FIG. 1, and for purposes of emulating athletic maneuvers in the sport of ice hockey, the device 10 is operable to be rolled along the path of travel 11, which is substantially perpendicular to the line of reference 3—3.

The first form of wheel assembly 54, and which is illustrated in FIGS. 2 and 3, has a curved, earth engaging surface 58 which enables the device 10 to be operably rolled along the path of travel 11 at a plurality of angles relative to the axis of rotation 52 and the surface of the earth 12 to provide realistic ice hockey training to an end user. The curved earth engaging surface 58 can be manufactured from a substantially resilient, synthetic material which is operable to increase the friction of the wheel assembly 54 with the surface of the earth 12 thereby causing the wheel assembly 54 to more effectively engage the surface of the earth 12 while the device 10 is operably rolled along path of travel 11. Further, the wheel assembly 54 may be manufactured from metal, synthetic polymeric materials, or natural materials, and the weight of the wheel assembly 54 can range, but is not limited to 0.1 to 10 lbs.

FIGS. 2 and 3 illustrate a first means for releasably securing the wheel assembly 54 to the axle assembly 42. More particularly, this first releasable securing means, and which is indicated generally by the numeral 63, includes an axle assembly 42 which has formed therein a bore 65 which is disposed in the first end 44, a washer 67, and a cotter pin 69. As best seen by reference to FIG. 3, the centrally disposed bore 60 of the wheel assembly 54 is operable to rotatably receive the axle assembly 42. The wheel assembly 54 is releasably secured on the axle assembly 42 by placing the washer 67 on the axle assembly 42 in a position substantially past the bore 65 relative to the first end 44 and the cotter pin 69 is then inserted into the bore 65 thereby releasably securing wheel assembly 54 on the axle assembly 42.

Figure 4:
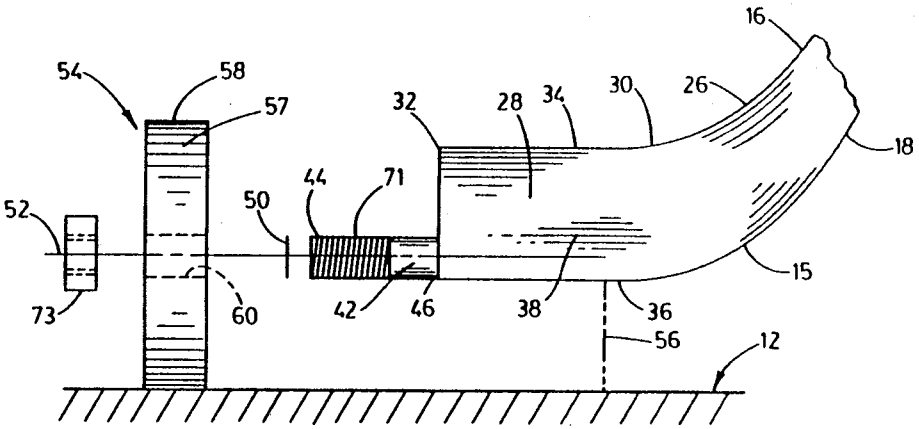
FIG. 4 is an exploded, fragmentary, longitudinal, side elevational view of an alternate form of the present invention and showing means for releasably securing a wheel to an axle assembly of the present invention.

FIG. 4 illustrates a second, alternate means for releasably securing wheel assembly 54 on the axle assembly 42. More specifically, FIG. 4 illustrates an axle assembly 42 which has a plurality of screw threads 71 which are formed in the first end 44 thereof. The centrally disposed bore 60 of the wheel assembly 54 is operable to rotatably receive the axle assembly 42, and the wheel assembly 54 is releasably secured on the axle assembly 42 by a threaded fastener 73 which engages the screw threads 71.

Figure 5:
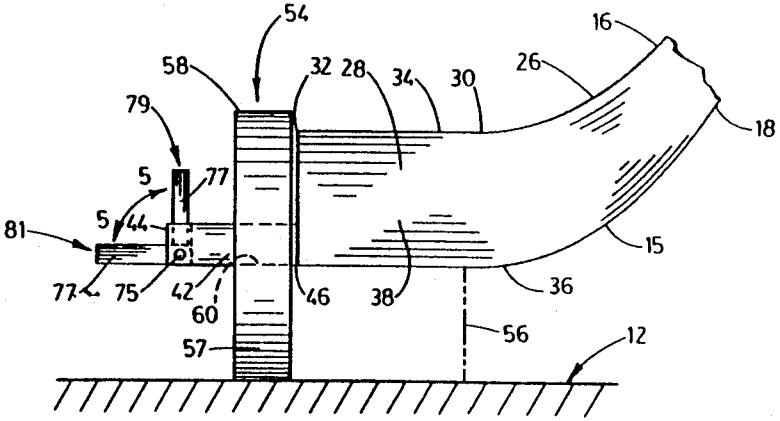
FIG. 5 is a fragmentary, longitudinal, side elevational view of an alternate form of the present invention and showing a means for releasably securing the wheel to the axle assembly of the present invention.

FIG. 5 illustrates a third, alternate means for releasably securing the wheel assembly 54 on the axle assembly 42. More particularly, FIG. 5 illustrates an axle assembly 42 which has a hinge pin 75 which is fixed on in the first end 44 thereof. A locking lever 77 is pivotally mounted on the hinge pin 75, and the locking lever 77 is movable along a substantially arcuately shaped path of travel which is labeled 5—5. The centrally disposed bore 60 of the wheel assembly 54 is operable to rotatably receive the axle assembly 42, and the wheel assembly 54 is releasably secured on the axle assembly 42 by pivotally moving locking lever 77 along the path of travel 5—5 and into a locked position which is indicated generally by the numeral 79. As best seen by reference to FIG. 5, the locked position 79 is substantially perpendicular relative to the axle assembly 42. To remove wheel assembly 54, the locking lever 77 is moved along the path of travel 5—5, and into an unlocked position which is indicated generally by the numeral 81, and which is disposed in substantially coaxial alignment relative to the axle assembly 42.

Figure 10:
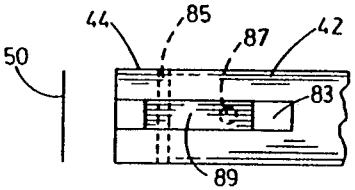
FIG. 10 is a fragmentary, top plan view taken from a position along line 10—10 of FIG. 6, and showing alternate means for releasably securing the wheel to the axle assembly of the present invention.
Figure 6:
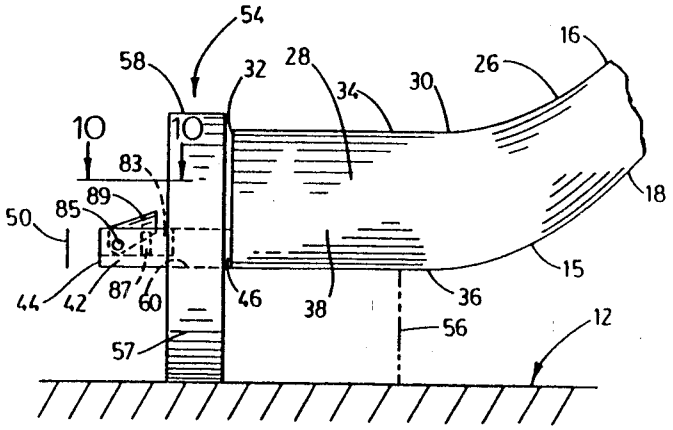
FIG. 6 is a fragmentary, longitudinal, side elevational view of an alternate form of the present invention and showing a means for releasably securing the wheel to the axle assembly of the present invention.

FIGS. 6 and 10 illustrate a fourth alternate means for releasably securing the wheel assembly 54 on the axle assembly 42. More specifically, FIGS. 6 and 10 illustrate an axle assembly 42 which includes a locking tab recess 83. A hinge pin 85 is mounted on the first end 44 of the axle assembly 42 and disposed transversely relative to the locking tab recess 83. Further, a biasing member 87, such as a coiled spring, is disposed in a predetermined position relative to the locking tab recess 83. A locking tab 89 is pivotally mounted on the hinge pin 85, and rests on the biasing member 87. The centrally disposed bore 60 of the wheel assembly 54 is operable to rotatably receive the axle assembly 42. Movement of the wheel assembly 54 onto the axle assembly 42 causes the locking tab 89 to be depressed into the locking tab recess 83 against the force of the biasing member 87. After the wheel assembly 54 has been placed in a location past the locking tab 89, the biasing member 87 is operable to move the locking tab 89 into a position which extends substantially, radially, outwardly relative to the axle assembly 42, thereby releasably securing the wheel assembly 54 on the axle assembly 42. The wheel assembly 54 is releasable from the axle assembly 42 by depressing the locking tab 89 into the locking tab recess 83 while simultaneously removing the wheel assembly 54 from the axle assembly 42.

Figure 7:
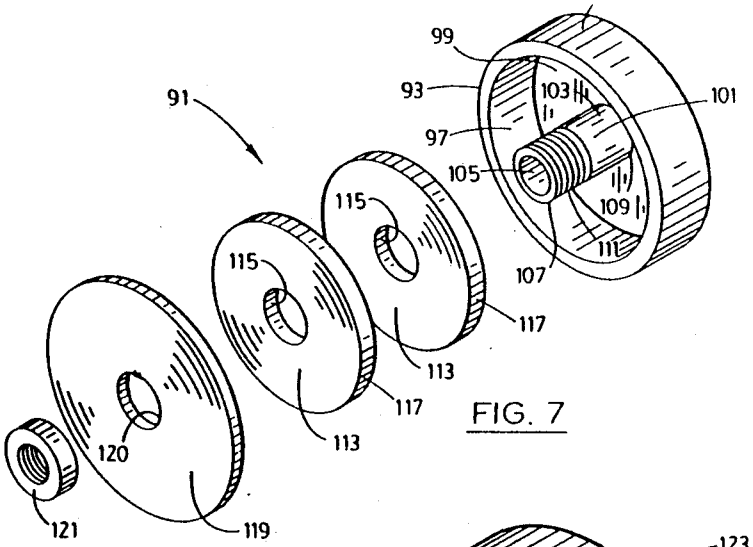
FIG. 7 is an exploded, perspective view of an alternate form of the wheel for use with the athletic training device of the present invention.

FIG. 7 illustrates a second alternate embodiment of the wheel assembly 54. More particularly, FIG. 7 illustrates a wheel assembly 91 which includes a main body 93 having a outwardly disposed surface 95 which defines an outer diametral dimension for same, and which further has an inwardly disposed surface 97 which defines an inner diametral dimension. The main body 93 includes a sidewall or member which has an inwardly disposed surface 99, an opposed, outwardly disposed surface, not shown, and a centrally disposed bore having a predetermined diametral dimension. The main body 93 further includes a stem 101 having an outwardly disposed surface 103 which defines an outer stem diametral dimension, and having an inwardly disposed surface 105 which defines a passageway having a diametral dimension substantially equal to the diametral dimension of the centrally disposed bore of the sidewall. Moreover, the stem 101 has first and second ends indicated by the numerals 107 and 109, respectively. As best seen by reference to FIG. 7, the stem 107 has a plurality of screw threads 111 formed in the first end 107 thereof, and the second end 109 is fixed or made integral with the inwardly disposed surface 99 of the sidewall and is disposed in a position in substantially coaxial registery with the bore formed in the sidewall. A plurality of circular weights 113, having respective stem mounting bores 115, which are equal to or greater than the outside diametral dimension of the stem, are provided. The circular weights 113 each have a peripheral edge 117 which defines a diametral dimension less than the inner diametral dimension defined by the inwardly disposed surface 97 of the main body 93. The wheel assembly 91 further includes a cover 119 which has a central bore 120, and which further has a diametral dimension substantially equal to the outside diametral dimension of the main body 93. A threaded fastener 121 is operable to engage the plurality of threads 111 of the first end 107 of the stem 101 thereby securing the cove 119 in occluding relation relative to the main body 93 and thereby capturing the circular weights 113 in the main body 93. In operation, a user of the device 10 would select the amount of weight for the wheel assembly 91 by selecting a desired number of circular weights 113. Thereafter, the circular weight(s) 113 would be placed on the stem 101. The wheel assembly 91 would then be made operable by placing the main body cover 119 on the stem 101 and by threading the threaded fastener 121 onto the threads 111 which are formed in the first end 107 of the stem 101.

Figure 8:
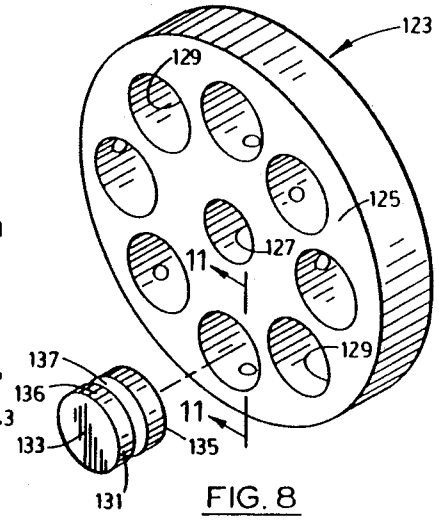
FIG. 8 is a perspective view of an alternate form of the wheel for use with the athletic training device of the present invention.

FIG. 8 illustrates a third wheel assembly 123 which is an alternate embodiment of the wheel assembly 54. More particularly, FIG. 8 illustrates a main body 125 which defines a central bore 127 having a predetermined diametral dimension, and which further includes an even number of diametrically opposed, and substantially cylindrically shaped weight support chambers 129. A plurality of substantially cylindrically shaped weights 131 having a predetermined diametral dimension are operable to be individually and slidably received in each of the weight support chambers 129. Each of the cylindrically shaped weights 131 have opposite first and second ends, indicated by the numerals 133 and 135 respectively, and an exterior surface 136. Further each of the cylindrically shaped weights 131 includes a circumscribing groove 137 which is formed in the exterior surface 136 thereof and which is disposed substantially intermediate the first and second ends 133 and 135. As should be understood, the weight support chambers 129 are positioned in diametrically opposite locations on the main body 125 to provide a means for balancing wheel assembly 123 when selecting a predetermined weight for athletic training.

Figure 11:
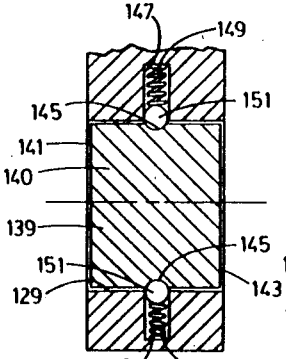
FIG. 11 is a fragmentary, vertical, sectional view taken from a position along line 11—11 of FIG. 8.

FIG. 11 is illustrative of one of the weight support chamber 129 which is made integral with the main body 125. More particularly, each weight support chamber 129 is adapted to telescopingly receive a substantially cylindrically shaped sleeve 139. Each sleeve 139 has an interior surface 140, and opposite first and second ends which are indicated by the numerals 141 and 143 respectively. Further, each sleeve has formed therein a pair of circular bores 145 having a predetermined diametral dimensions and which are positioned intermediate the first and second ends 141 and 143. The diametral dimension of the sleeve 139 which is defined by the surface 140, is greater than the diametral dimension of the cylindrical weights 131. Each weight support chamber 129 further includes a pair of channels 147. Each channel 147 is dimensioned to receive a biasing spring or member 149. Upon each biasing member 149 rests a ball bearing 151 having a predetermined diametral dimension which is greater than the diametral dimension of the circular bore 145. Each biasing member 149 is operable to individually urge a ball bearing 151 into one of the circular bores 145 thereby positioning it in partially occluding relation relative to the passageway defined by the surface 140 of the sleeve 139. In operation, a user selects a pair of cylindrical weights 131, and places the respective cylindrical weights 131 in respective, diametrically opposite weight support chambers 129. Movement of the cylindrical weights 131 into the respective weight support chambers 129 causes a simultaneous depression of both of the ball bearings 151 into the channels 147 and a corresponding compression of each biasing member 149. When a user has properly positioned weight 131 into the weight support chamber 129, the biasing members 149 urges the respective ball bearings 151 into a space defined by the circumscribing groove 137 of the cylindrical weight 131 thereby retaining the respective cylindrical weights 131 in each of the respective weight support chambers 129.

SECOND FORM

The apparatus of the second form of the present invention is generally indicated by the numeral 153, and is best illustrated by reference to FIG. 9.

Figure 9:
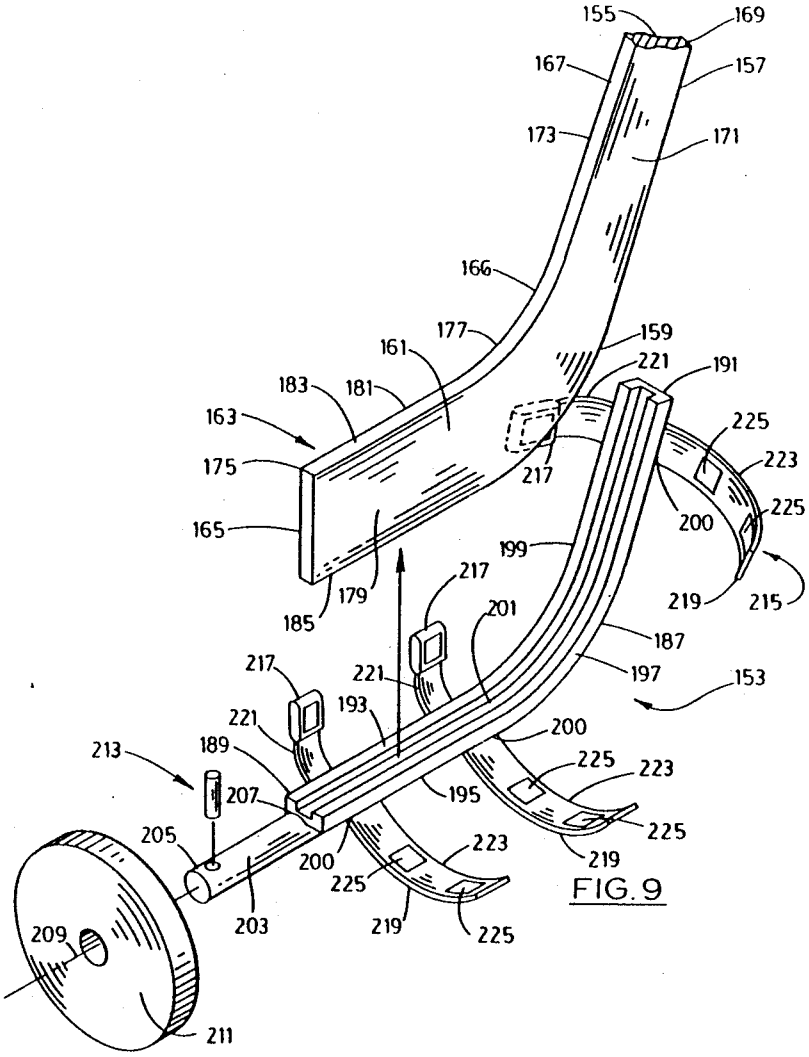
FIG. 9 is an exploded, fragmentary, perspective view of a second form of the athletic training device of the present invention.

FIG. 9 illustrates a conventional ice hockey stick 155 which includes a shaft 157, a heel 159, a blade 161, a blade end indicated generally by the numeral 163, and a toe 165.

Referring more particularly to FIG. 9, the ice hockey stick 155 has an elongated, substantially rectangular shaped shaft 157 that has a proximal end, not shown, a distal end 166, a top surface 167, an opposed bottom surface 169, and lateral surfaces 171, and 173. The rectangular shaft has a predetermined width, and thickness. The blade 161 has opposite first and second ends represented by the numerals 175 and 177 respectively, a front striking surface 179, an opposed rear striking surface 181, a top peripheral edge 183, a bottom edge peripheral edge 185 and a toe 165.

FIG. 9 further illustrates in detail the second form 153 of the present invention.

As should be understood, the second form 153 of the present invention releasably attaches to the blade end 163 of the ice hockey stick 155. The second form 153 includes a base assembly 187 which is shaped to conform to the blade end 163 of the ice hockey stick 155. The base assembly 187 has opposite first and second ends represented by the numerals 189 and 191 respectively, a top exterior surface 193, an opposed bottom exterior surface 195, a first lateral surface 197, and an opposed second lateral surface 199. Further, the base assembly 187 includes a plurality of transversely disposed slots 200 which are formed in the bottom exterior surface 195. The base assembly 187 defines a longitudinal channel 201 which is positioned in the top exterior surface 193 and which is positioned intermediate the first lateral surface 197 and the second lateral surface 199. The longitudinal channel 201 has a predetermined depth relative to the exterior surface 193, and a predetermined width. The second form 153 further includes a substantially cylindrically shaped axle assembly 203 which has opposite first and second ends indicated by the numerals 205 and 207 respectively, and which provides a axis of rotation 209 for a wheel assembly 211 which is operable for rotatable movement about axle assembly 203. The second end 207 of the axle assembly 203 is made integral with the first end 189 of the base assembly 187 and extends substantially longitudinally outwardly from the first end 189 of the base assembly 187. As should be understood, the base assembly 187 and the axle assembly 203 may be manufactured from a variety of natural, or synthetic materials, however, the base assembly 187 and the axle assembly 203 should be manufactured as a unitary structure for stress, strain, and strength considerations.

Wheel assembly 211, as illustrated in FIG. 9, has a predetermined weight to provide weighted resistance for strength training during use of the device of the second form 153. The wheel assembly 211 may be replaced by the wheel assembly 91 or the wheel assembly 123 described in detail above, and which are illustrated in FIGS. 7, 8 and 11.

Referring to FIG. 9, the numeral 213 generally illustrates a means for releasably securing the wheel assembly 211 to the axle assembly 203. As should be understood, the releasable securing means 213 may incorporate any of the aforementioned means for securing the wheel assembly 54 to the axle assembly 42 of the first form of the present invention, and which are illustrated in FIGS. 2, 3, 4, 5, 6 or 10. The numeral 215 generally illustrates a means for attaching the second form 153 to the blade end 163 of the ice hockey stick 155. More particularly the attaching means 215 consists of a plurality of buckle devices 217, and a plurality of flexible straps 219 having a buckle end 221 and an opposed end 223.

In operation, the device of the second form 153 of the present invention is attached to the blade end 163 of the ice hockey stick 155. More particularly, the bottom peripheral edge 185 of the blade 161, and the bottom surface 169 of the distal end 166 of the shaft 157 are conformably inserted into the longitudinal channel 201. When the ice hockey stick 155 is properly inserted into the longitudinal channel 201, first end 189 of the base assembly 187 is substantially flush with the toe 165 and the second end 191 is disposed in a position past the heel 159. The second end 191 of the base assembly 187 must attach substantially past the heel 159 to prevent the device of the second form 153 from disengaging from the ice hockey stick 155. The base assembly 187 is made secure for operation by inserting the respective flexible straps 219 through the respective transversely disposed slots 200, and by wrapping the flexible straps 219 about the blade end 163. The respective flexible straps 219 thereafter engage the respective buckle devices 217, and then, suitable hook and pile loop type fabric 225, such as Velcro®, secures the respective end 223 of the flexible straps 219. Thereafter, a user mounts a wheel assembly 211 onto the axle assembly 203, and releasably secures the same with means 213 to render the second form 153 of the present invention operable to support the bottom peripheral edge 185 of the blade 161 in spaced relation to the surface of the earth, and wherein movement of the blade 161 across the surface of the earth 12 causes rotation of the wheel assembly 211 to facilitate movement of the device 153 in a predetermined pattern to emulate an athletic event while simultaneously providing weighted resistance for athletic conditioning.

Since various modifications can be made in my invention as herein above described, and many apparently widely different embodiments of the same may be made within the spirit and scope of the claims of the present invention without departing from such spirit and scope, it is intended that all matter contained in the above-accompanied specification shall be interpreted as illustrative only and not in a limiting sense.

Having described my invention, what I claim as new and desire to secure by Letters Patent is:

1. An all-season ice hockey training device for use with a conventional hockey puck, and which is operable for use on any supporting surface to simultaneously provide aerobics training and weight training to an athlete, the ice hockey training device comprising:

an ice hockey stick having an elongated shaft and a striking surface, the elongated shaft including a proximal end which is adapted to be grasped to maneuver the device, and an opposite distal end, and wherein the striking surface includes a main body having opposite first and second ends, the first end being made integral with the distal end of the shaft;

an axle assembly mounted on the second end of the main body and which extends outwardly therefrom thereby defining an axis of rotation;

a weighted wheel having an earth-engaging surface and a central bore, and wherein the axle assembly is received by the central bore which rotatably mounts the weighted wheel about the axis of rotation, and which supports the striking surface a predetermined distance above the supporting surface, the predetermined distance being less than the height dimension of the hockey puck thereby permitting the ice hockey training device to rollingly engage the surface of the earth while also permitting the striking surface to strike the hockey puck during use thereof; and means for releasably securing the weighted wheel on the axle assembly, and wherein during use, the ice hockey training device is operable to be maneuvered in substantially continuous rolling engagement across the surface of the earth in such a fashion to emulate typical ice hockey stick movements which thereby provides aerobic training to an athlete while simultaneously providing weighted resistance by way of the weighted wheel, for athletic conditioning.

2. An all-season ice hockey training device, as claimed in claim 1, and wherein the weight of the wheel is in a range from 0.1 to 10 pounds.

3. An all-season ice hockey training device, as claimed in claim 2, and wherein the wheel has an earth engaging surface composed of a resilient material.

4. An athletic training device, as claimed in claim 1, and wherein the wheel is hollow and is operable to receive a plurality of removable weights thereby providing the athlete with a selected range of weighted resistance for athletic training.

5. An athletic training device, as claimed in clam 1, and wherein the axle assembly has a distal end which has formed therein a plurality of screw threads, and wherein the means for releasably securing the wheel on the axle assembly includes a threaded fastener, which is operable to screwthreadably engage the distal end of the axle assembly.

6. An athletic training device, as claimed in claim 1, and wherein the axle assembly has a distal end, and wherein the means for releasably securing the wheel on the axle assembly includes a spring biased locking tab.

7. An athletic training device, as claimed in claim 1, and wherein the axle assembly has a distal end and wherein the means for releasably securing the wheel on the axle assembly includes a locking lever which is pivotally mounted on the distal end and which is operable for movement along a path of travel from a first position wherein it is substantially coaxially aligned with the axle assembly and which permits the wheel to be rotatably positioned on the axle assembly, to a second position wherein the locking lever is disposed in a position substantially perpendicular to the axle assembly thereby releasably securing the wheel on the axle assembly.

8. An all-season ice hockey training device for use with a conventional puck and which simultaneously provides aerobic and weight training to an athlete, the ice hockey training device comprising:

an ice hockey stick having an elongated shaft and a blade;

an axle assembly mounted on the blade and which extends outwardly therefrom thereby defining an axis of rotation;

a weighted wheel having a central bore, and wherein the axle assembly is received in the central bore thereby rotatably mounting the wheel about the axis of rotation, the wheel supporting the blade a predetermined distance above the supporting surface, and wherein this predetermined distance is less than the height dimension of the puck; and means for releasably securing the wheel on the axle assembly, and wherein during use, the ice hockey training device is maneuvered by the athlete across the surface of the earth, and in such a fashion to emulate typical ice hockey stick movements while simultaneously providing aerobic and weighted resistance training by way of the weighted wheel.

9. An athletic training device, as claimed in claim 8, and wherein the wheel is hollow and is operable to selectively receive a plurality of removable weights thereby providing the athlete with a selected range of weighted resistance for athletic training.

10. An athletic training device, as claimed in claim 8, and wherein the axle assembly has a distal end which has formed therein a plurality of screw threads, and wherein the means for releasably securing the wheel on the axle assembly includes a threaded fastener, which is operable to screwthreadably engage the distal end of the axle assembly.

11. An athletic training device, as claimed in claim 8, and wherein the axle assembly has a distal end, and wherein the means for releasably securing the wheel on the axle assembly includes a spring biased locking tab.

12. An athletic training device, as claimed in claim 8, and wherein the axle assembly has a distal end and wherein the means for releasably securing the wheel on the axle assembly includes a locking lever which is pivotally mounted on the distal end and is operable for movement along a path of travel from a first position wherein it is coaxially aligned with the axle assembly and which permits the wheel to be rotatably positioned on the axle assembly, to a second position wherein the locking lever is disposed in a position substantially perpendicular to the axle assembly thereby releasably securing the wheel on the axle assembly.

* * * * *